United States Patent [19]

King

[11] Patent Number: 4,845,803

[45] Date of Patent: Jul. 11, 1989

[54] MOVABLE HAND GRIP WITH ACTUATION

[75] Inventor: Douglass A. King, North Canton, Ohio

[73] Assignee: The Hoover Company, North Canton, Ohio

[21] Appl. No.: 944,514

[22] Filed: Dec. 22, 1986

[51] Int. Cl.[4] ..... A47L 9/32

[52] U.S. Cl. ..... 15/339; 15/410; 180/19.3; 200/330

[58] Field of Search ..... 15/410, 339; 180/19.3; 200/157, 330, 337

[56] References Cited

U.S. PATENT DOCUMENTS

| | | | |
|---|---|---|---|
| 2,842,788 | 7/1958 | Rench et al. | 15/410 X |
| 3,398,250 | 8/1968 | Bowers | 200/330 X |
| 4,115,670 | 9/1978 | Chandler | 200/330 X |
| 4,421,964 | 12/1983 | Buchtel | 200/157 |
| 4,624,027 | 11/1986 | Martin | 180/19.3 X |

*Primary Examiner*—Chris K. Moore

[57] ABSTRACT

A cleaner having a rectilinearly movable hand grip, movable along the axis of the cleaner handle, is provided with a switch actuator that can initiate action of a switch fixed relative to the handle and, therefore, not movable with the hand grip. The switch actuator includes a lost motion arrangement engageable over a switch button of the switch so that the switch actuator and switch remain in an engaged position independent of the axial location of the hand grip. The cleaner may be a power drive cleaner in which movement of the hand grip controls power driven movement of the cleaner. In this case, the hand grip and handle may have provision for placing the cleaner in a non-drive, neutral position.

11 Claims, 3 Drawing Sheets

MOVABLE HAND GRIP WITH ACTUATION

BACKGROUND OF THE INVENTION

1. Field of the Invention

This invention relates to floor care appliances and, more specifically, to a vacuum cleaner having a movable hand grip with cleaner switch initiation on the movable hand grip.

2. Summary of the Prior Art

Although hand grips that are axially movable along the handle of a cleaner are known, most notably in power drive cleaners where axial movement of the cleaner's hand grip initiates forward or rearward movement of power drive cleaner, heretofore the operator contactable portion of the on-off switch for the cleaner has been located on the relatively immovable handle because of the necessity of fixed wiring. However, this location of the operator initiated means for switching does not place it in as readily an accessible location as it would be if it were near the operator's hand during cleaner operation. Further, if, for example, a power surge fixture is also to be incorporated in the on-off switch, its initiating location becomes even more critical.

Accordingly, it is an object of this invention to provide a control for the on-off switch of a cleaner on a hand grip.

It is a further object of the invention to provide an operator initiated means for inducing switching located on a movable hand grip.

It is a still further object of the invention to provide an operator contactable means on a hand grip having a connecting means for engaging a relatively fixed switch on a cleaner handle.

It is an even further object of the invention to provide an on-off switch on a handle of a cleaner, an operator contactable switch actuating mechanism on a movable hand grip and a lost motion connection therebetween to accommodate movement of the hand grip relative to the handle.

Other and further objects of the invention will occur to the reader as the remainder of this Specification is reviewed.

SUMMARY OF THE INVENTION

This invention comprehends the use of operator contactable arrangement mounted on a hand grip which, in turn, is engageable with an on-off switch for the cleaner mounted on its handle. More specifically, the cleaner may take the form of a power driven floor care appliance having a hand grip movable axially and reciprocatorily along its handle to control forward and rearward movement of the power propelled cleaner over the floor which it is cleaning. In order to provide a relatively fixed location for the switch that controls the cleaner it is located, as is conventional, on the handle. However, to yield more convenience for the cleaner operator in utilizing this fixed switch, a switch operator in the form of a movable button is mounted on the hand grip so as to be as accessible as possible to the user of the cleaner. Since the hand grip moves relative to the handle, a lost motion connection is included in the structure between the operator initiated means and the switch.

This can be accomplished in the following manner. The switch which may be an on-off and/or power surge switch is located so that the switch button on it operates in a reciprocatory, horizontal manner, perpendicular to the axis of movement of the hand grip on the handle. The operator contactable means for switch actuation also takes the form of a button reciprocatorily moving, perpendicular to the axle of hand grip moving. The lost motion means between them is formed by a pair of tracks that are fixed to extend axially along the rear side the operator contactable button and are disposed on opposite ends of the switch button on the handle. Thus, vertical, axial reciprocation of the hand grip is accommodated by the channel forming ribs or tracks sliding along the switch button axially and moving it into one of its energizing or disenergizing modes only when the tracks are moved horizontally, under the aegis of the operator contactable means to which they are attached.

Since the structure just described finds its greatest use in a power drive cleaner, the movable hand grip may also include a neutral button that centers the cleaner drive in either forward or reverse. Accommodations for movement of the hand grip by this structure is accomplished by a transverse slot, widened at one end to permit vertical movement of the hand grip and narrowed at the other end to center the drive. An external button mounted with the grip and having a pin riding in the slot then provides neutral.

BRIEF DESCRIPTION OF THE DRAWINGS

Reference may now be had to the accompanying Drawings for a better understanding of the invention, both as to its organization and function, with the illustration being of a preferred embodiment, but being only exemplary, and in which.

DETAILED DESCRIPTION OF THE DRAWINGS

Figure 1:
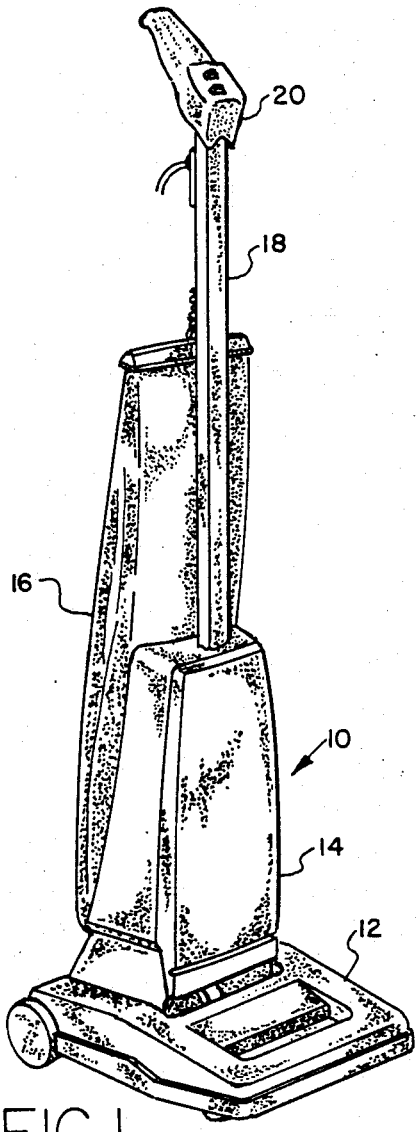
FIG. 1 is a perspective view of a power drive vacuum cleaner that incorporated the invention.
Figure 9:
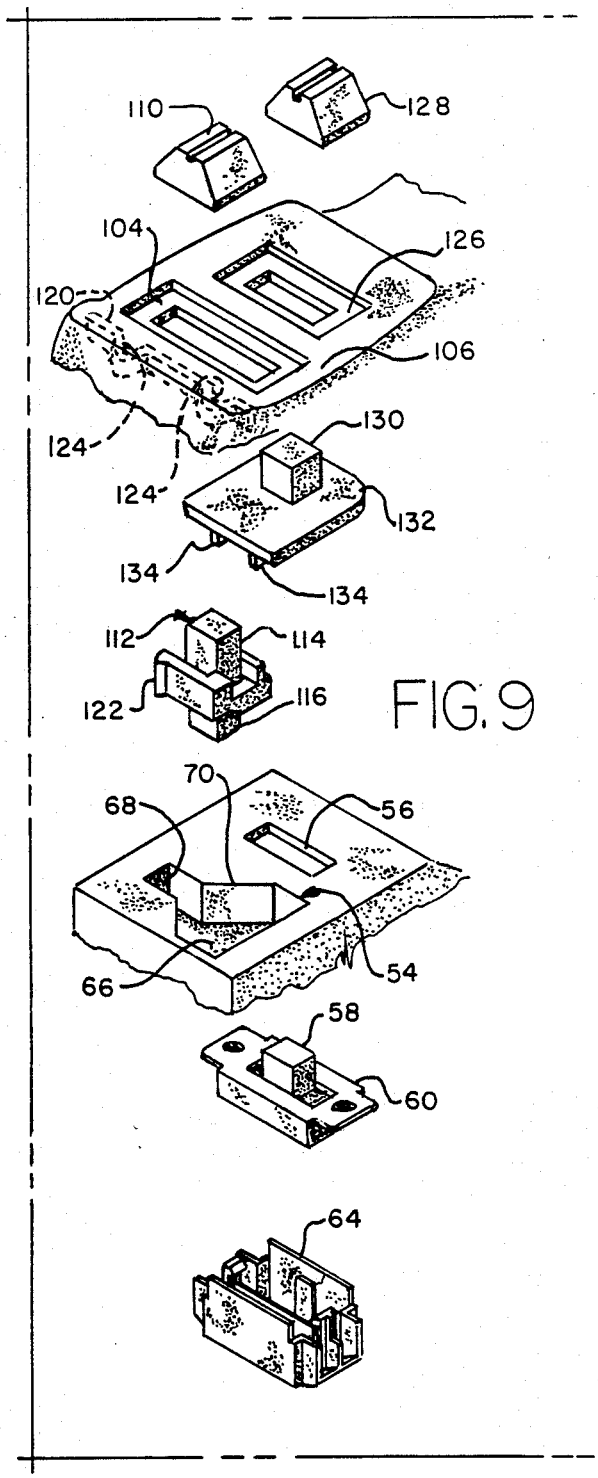
FIG. 9 is an exploded, partially fragmentary, perspective view of the switch and neutral actuating mechanism of the power drive cleaner.
Figure 4:
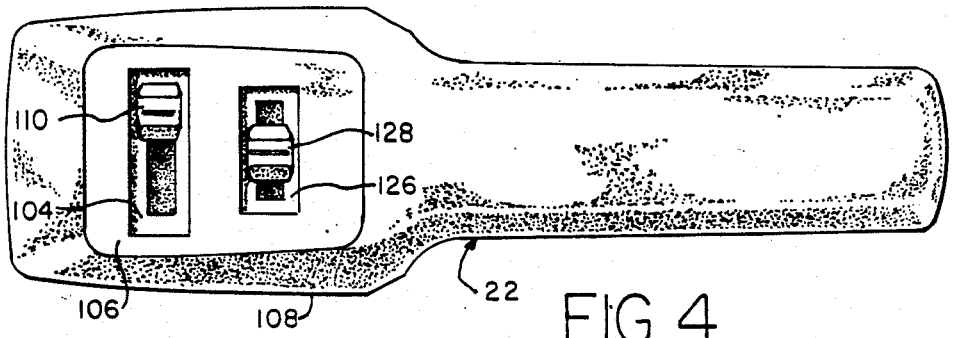
FIG. 4 is a top plan view of the upper half of the hand grip with the actuating buttons installed.

There is shown in FIG. 1 a power drive cleaner 10 having a hood 12 and a hard bag housing 14, conventionally pivoted thereto, and to which is connected a soft bag 16 that stores a dirt collecting bag (not shown). A handle 18 is fixedly attached to hard bag housing 14 to extend thereabove to movably mount a hand grip 20. The hand grip 20, as is conventional in power drive cleaners, reciprocates axially relative to the handle 18 to provide forward, neutral and rearward movement to the power drive cleaner 10.

The hand grip 20 is comprised of two exterior parts, upper hand grip portion 22 and lower hand grip portion 24. These two portions, when mated, form the general outer periphery of hand grip 20 and contain therein a hand grip support 26 to which the hand grip 20 is mounted to the handle 18 and a cylindrical seating member 28 that limits wear on the parts as the hand grip 20 reciprocates relative to the handle 18 and the hand grip support 26.

Hand grip support 26 is mounted with handle 18 by a telescoping section 30 inserted within it that includes side walls 32, 32, a center rib 34, for strengthening purposes, and upper wall 36. The telescoping section 30 is received within an upper portion 38 of handle 18 in close conforming relationship, with a screw 40 extending through the bottom side of upper portion 38 of handle 18 and threadedly received in boss 41 in the telescoping section 30 of hand grip support 26 to maintain the hand grip support 26 with the handle 18. The screw 40 may also be utilized to hold a bag hangar structure 42 to the upper end of handle 18.

Behind or above the telescoping section 30 of hand grip support 26, the hand grip support includes two depending side walls 44, 44 that are extensions of the side walls 32, 32 and a top wall 46. The intermediate rib 34 also extends into this portion of the hand grip support 26. The rear of the hand grip support 26 is comprised of a stepped cylindrical portion 48, having a varied wall thickness, that juts integrally out of a rear wall 50 of the hand grip support 26, with the cylindrical portion 48 coaxial with the remainder of the hand grip support 26. The rearward end of hand grip support 26 is generally completed by an axially extending grooved depression 52 on the top side of the cylindrical portion of hand grip support 26 that begins approximately medially of the linear extent of the cylindrical portion 48 and terminates at the rearward termination of it. This groove serves as a guide means for structure later to be detailed.

The top wall 46 of hand grip support 26 includes a forward, shaped symmetrical depression 54, forming a centering groove, and a through slot 56 disposed behind the shaped depression. The through slot 56 receives, extending outwardly therethrough a switch button 58 of a switch 60, the switch 60 being lodged within the hand grip support 26 by a discontinuity 62 in central rib 34. A resilient clamp 64 may be disposed around the switch 60 and interposed between it and the center rib 34 to hold the switch 60 with the hand grip support 26 and serve as a shield for it.

The shaped depression 54 in top wall 46 includes generally rectangularly shaped sections 66 and 68 joined by a tapered section 70 and with the rectangularly shaped section 66 being larger. This depression aids in placing the cleaner 10 in drive or neutral position as will appear.

The upper and lower hand grip portions 22, 24 telescopically mount over the hand grip support 26 by elongated tabs 71, 71 on the lower hand grip portion sliding under a pair of inwardly extending, confronting tabs 72, 72 mounted on a bottom side 74 of the upper hand grip portion 22 so that the upper and lower hand grip portions mate generally along their longitudinal extents. The bottom side 74 of upper hand grip portion 22 and a top side 76 of lower hand grip portion 24 are provided with stepped edge sections 78, 80, respectively, along their bottom outside shell-like peripheries so that these two portions mate easily along their edges.

At their rearward ends, upper and lower hand grip portions 22, 24 are connected by a screw 81 which mounts through an inwardly extending, hollow boss 82 on lower hand grip portion 24 and a threaded, solid inwardly extending confronting boss 84 in upper hand grip portion 22. Also ribs 86 and 88 on the upper and lower hand grip portions 22, 24, respectively, strengthen and rigidify their assembly.

The hand grip 20, as previously mentioned, is mounted to reciprocate relative to the handle 18. This is occasioned by the following structure: cylindrical bearing member 28 which may be made of a durable, wear resistant plastic, is mounted over cylindrical portion 48 of hand grip support 26 by a bore 90 that extends through bearing member 28 so that bearing member may slide on cylindrical portion 48 of the hand grip support. Adjacent the rearward end of cylindrical bearing member 28 is disposed a through slot 92. This slot extends axially of the cylindrical bearing member 28 and is disposed generally above the grooved depression 52 of the hand grip support 26. Within the slot 92 and the grooved depression 52 is received an integral elongated boss 94 of upper hand grip portion 22. This boss is sized axially to fit within through slot 92 with little play and is sized radially to extend into the grooved depression 52 without abutment on a bottom 95 of grooved depression 52. It should be clear then that the cylinder bearing member 28 bearingly slides along the hand grip support 26 with the hand grip 20 as it moves relative to handle 18 while the elongated boss 94 and grooved depression 52 guide the hand grip axially in this movement.

In order to provide impetus to the conventional power drive cleaner 10 a sheathed Bowden wire 96 extends up the handle 18. The Bowden wire provides for shifting of the cleaner transmission (not shown) as is conventional by moving rectilinearly in the handle 18. This motion is imparted to the Bowden wire by the hand grip 20, to which it is mounted, by a hooked end 98 of it that extends into a bore 100 formed in an integral, inwardly extending boss 102 in the rear end of upper hand grip portion 22. Movement of the hand grip 20, rectilinearly, then moves the sheathed Bowden wire 96 rectilinearly in the handle 18.

An operator contactable mechanism for insuring neutral for the power driven cleaner 10 by centering the sheathed Bowden wire 96 is included. An elongated, vertically stepped slot 104 is disposed so as to extend transverse to the axis of the upper hand grip 22 in an upper side 106 of an enlarged forward portion 108 of the upper hand grip. An operator contactable hollow button 110 is disposed above the stepped slot 104, and is wedgingly mounted (not shown) on a double pin and slide member 112. It includes an upwardly standing pin 114 for mounting the button 110 and a downwardly depending pin 116 that rides in shaped depression 54 in hand grip support 26. Between these two pins on the double pin and slide member 112 is an integral guide 121 that slides transversely relative to the hand grip 20 along it beneath the stepped slot 104. A pair of ribs 118, 120, integral with the upper grip hand portion 22 and depending downwardly from it form a channel for the guiding reception of the double pin and slide member 112. Portions of the inner surface (unnumbered) of the upper hand portion limit outward movement of the integral guide 121 of the double pin and slide member 112. An outwardly, sidewardly extending detent 122 may be formed of the integral guide 121 that can mate with, alternately, one of a pair of detent wells 124, 124 formed on the integral rib 120 on upper hand grip portion 22.

Figure 3:
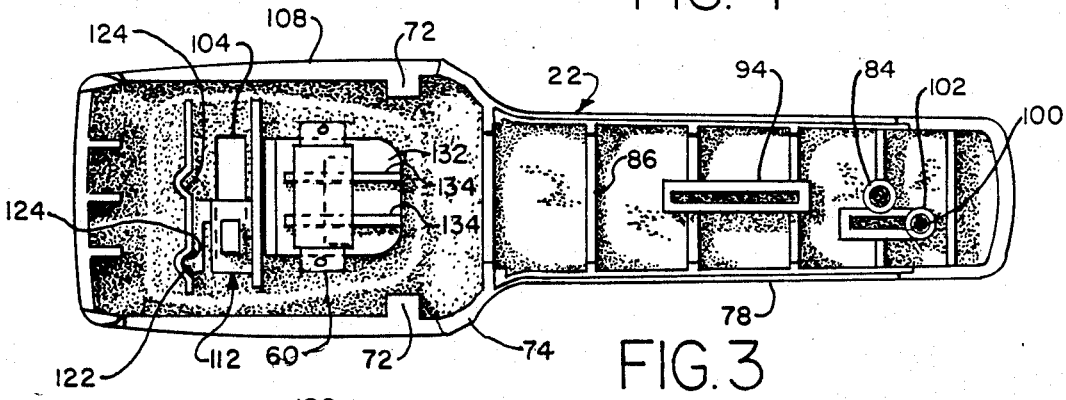
FIG. 3 is a bottom plan view of the upper half of the hand grip with the switch and neutral actuators in assembled position.
Figure 2:
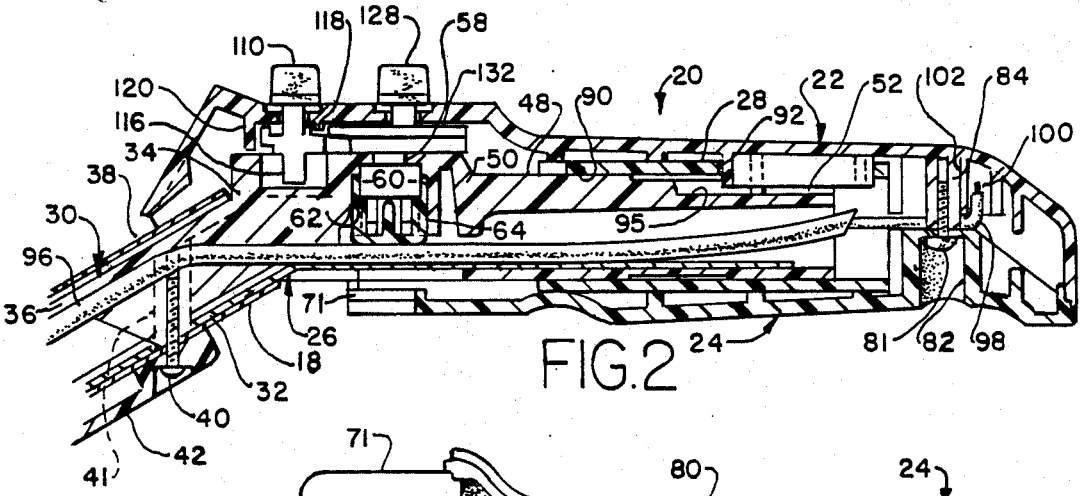
FIG. 2 is a cross-sectional view of the hand grip area of the vacuum cleaner of FIG. 1, with the switch wiring removed.
Figure 6:
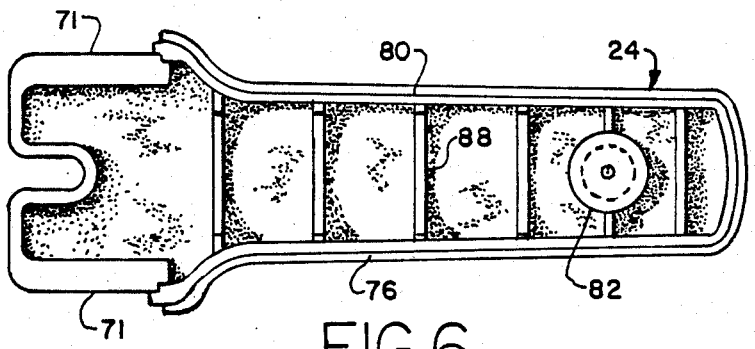
FIG. 6 is a top plan view of the bottom half of the hand grip.
Figure 7:
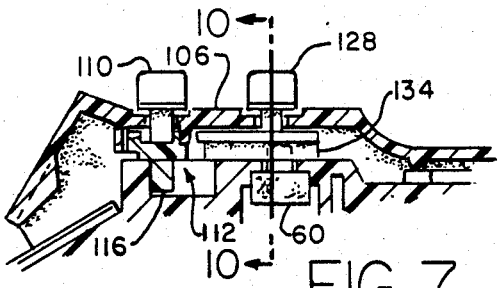
FIG. 7 is a fragmentary showing of a portion of FIG. 2 with the hand grip in a position exemplifying forward movement for the power drive cleaner.
Figure 8:
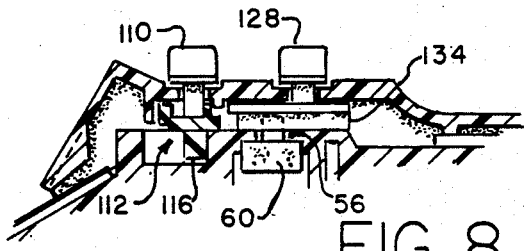
FIG. 8 is a similar view of the hand grip exemplifying reverse movement for the drive for the power drive cleaner.

It should now be clear, with the detent 122 located in the lowest detent well 124 in FIG. 3 (the button 110 at the left of stepped slot 104 from an operator's position), that the depending pin 116 is located in the large part of the shaped depression 54. The hand grip 20, (carrying the pin 116) is then free to move axially in either direction limited by the forward and rearward ends of the depression 54, to initiate forward or rearward movement of the power drive cleaner 10. However, if the button 110 is slid to the rightward side of the stepped slot 104, the integral pin 116 acts as a cam against the angled sides of tapered portion 70 of shaped depression 54, centering the pin 116 and the hand grip 20 simultaneously to place the slotted Bowden wire 96 in a neutral position relative to initiation of a forward or rearward movement of the power drive (not shown) of power drive cleaner 10.

The upper side 106 of upper hand grip portion 22 also has opening through it another transversely extending vertically, stepped slot 126, disposed axially rearwardly of stepped slot 104. A hollow button 128 wedgingly (not shown) engages an upwardly extending pin 130 that passes through stepped slot 126 so that operator initiation of the button 128 causes movement of the pin generally perpendicular to the axis of the hand grip 20. The pin 130 is integral with a side member 132 that is disposed below the bottom of upper side 106 of upper hand grip portion 22 and slides along it as guided by the pin 130 in the stepped slot 126.

Figure 10:
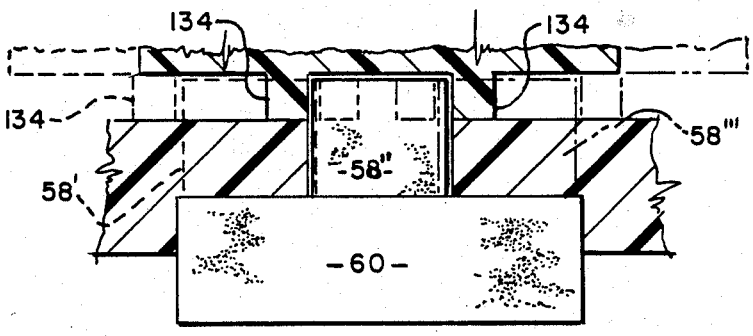
FIG. 10 is an enlarged view, generally schematic, of the switch button in its three positions of operation.
Figure 5:
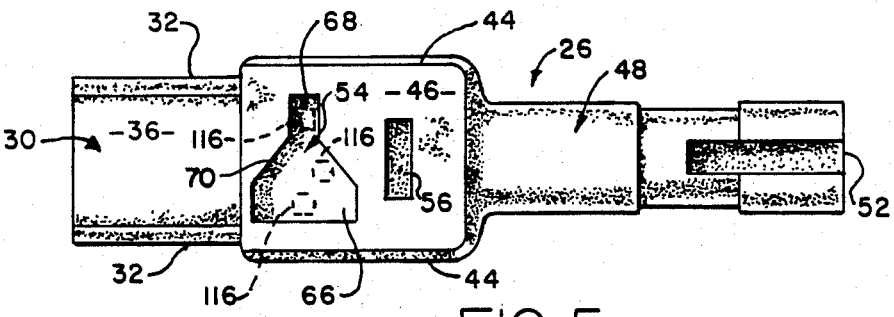
FIG. 5 is a top plan view of the hand grip support for the hand grip for the cleaner and showing the neutral actuating pin in a variety of positions.

On the bottom side of the slide member are a pair of depending, parallel tracks or ribs 134, 134 that serve as a guide means and a lost motion means so as to accommodate axial reciprocal movement of the hand grip 20 relative to switch 60, fixed on hand grip support 26. The ribs 134, 134 are centrally located on the slide member 132 and also extend axially on the slide member and are spaced sufficiently far apart to be located on opposite sides of switch button 58. Thus, movement of the hand grip 20 permits the ribs 134, 134 to slide along switch button 58 without interference to or from it. At the same time, the ribs 134, 134 are till maintained on opposite sides of the switch button 58 to permit sideward movement of them to place the switch 60 in one of its detented modes (preferably although not necessarily three positions, e. g., off, on and power surge). The off position 58' of the switch 60, the on position 58'' of the switch 60 and the third or power surge position 58''' of the switch 60 are shown in FIG. 10.

The operation of the switch actuating button 128 and the lost motion arrangement afforded by the ribs 124, 134 should now be clear. As the hand grip 20 is moved axially along the hand grip support 26, the ribs 134, 134 act as a lost motion means or tracks to maintain contact with the switch button 58 of switch 60. Thus, independent of hand grip location, the switch 60 may be initiated to its various positions by the switch actuating button 128.

It should be clear from the foregoing description that the advantages set out for it have been achieved and, further, that many modifications could obviously be made to the invention which would still fall within the spirit and purview of the description offered.

What is claimed is:

1. In a power drive cleaner having a mounted, movable hand grip including;

(a) an electric switch fixedly mounted to said power drive cleaner, (b) a means for initiating switch action mounted on said movable hand grip; and (c) a means for providing lost motion between said electric switch and said means for initiating switch action whereby said means for initiating switch action is operative independent of hand grip mounted movement.

2. In a cleaner having a handle pivotally attached to a cleaner hood and including;

(a) a hand grip movably mounted to said handle, (b) a switch mounted on said handle, and (c) an operator contactable means for initiating switch actuation, mounted on said movable handgrip.

3. The cleaner as set out in claim 2 wherein;

(a) a means for providing lost motion is functionally interposed between said switch and said means for initiating switch actuation.

4. The cleaner having a movable hand grip of claim 3 wherein;

(a) said switch and said lost motion means includes an upstanding member disposed between two parallel ribs.

5. The cleaner as set out in claim 3 wherein;

(a) said means for providing lost mostion includes a pair of ribs attached to one of said switch and said means for initiating switch actuation.

6. The cleaner having a movable hand grip of claim 5 wherein;

(a) said ribs are disposed on opposite sides of a button for said switch.

7. The cleaner as set out in claim 3 wherein;

(a) said means for providing lost motion is movable relative to said movable hand grip.

8. In a power drive cleaner having a handle and a movable hand grip, mounted to it to move in an axial direction therealong, the combination including;

(a) a pin mounted on said movable hand grip and movable relative to it in a direction transverse to said axial direction, (b) said pin extending into a means for centering said pin generally axially mounted and with said handle, (c) said pin reciprocating in a sliding motion along said means for centering said pin to place said pin in a centered or uncentered position.

9. In the power drive cleaner having a handle and the movable hand grip of claim 8 wherein;

(a) an electric switch is mounted to said handle, and (b) an operator contactable means for switch initiation is mounted to said movable hand grip.

10. The power drive cleaner as set out in claim 8 wherein;

(a) said means for centering said pin comprising a groove extending generally horizontally, transverse to said axial direction and being wider at one horizontal transverse end than the other horizontal transverse end.

11. The power drive cleaner as set out in claim 10 wherein;

(a) said ends are generally rectangular in plan view, and (b) said groove is tapered therebetween to horizontally space said ends.

* * * * *